US005095551A

United States Patent [19]

Chin

[11] Patent Number: 5,095,551

[45] Date of Patent: * Mar. 17, 1992

[54] MOTORCYCLE HELMET ANGLE-ADJUSTABLE WIND VISOR MOUNTING STRUCTURE

[76] Inventor: Chen L. S. Chin, No. 343, Chung Chen Rd., Yung Kang Hsiang, Tainan Hsien, Taiwan

[ * ] Notice: The portion of the term of this patent subsequent to Apr. 9, 2008 has been disclaimed.

[21] Appl. No.: 539,352

[22] Filed: Jun. 18, 1990

[51] Int. Cl.[5] ..... A42B 1/08

[52] U.S. Cl. ..... 2/424

[58] Field of Search ..... 2/6, 9, 10, 15, 422, 2/424, 425, 410

[56] References Cited

U.S. PATENT DOCUMENTS

| | | | |
|---|---|---|---|
| 4,170,792 | 10/1979 | Higgs | 2/10 |
| 4,292,688 | 10/1981 | Ellis | 2/6 |
| 4,866,792 | 9/1989 | Arai | 2/424 |
| 4,907,299 | 3/1990 | Arai | 2/424 |
| 4,920,585 | 5/1990 | Arai | 2/424 |
| 5,005,221 | 4/1991 | Chen | 2/424 |

FOREIGN PATENT DOCUMENTS

| | | | |
|---|---|---|---|
| 223139 | 5/1987 | European Pat. Off. | 2/424 |
| 2937356 | 4/1980 | Fed. Rep. of Germany | 2/424 |
| 3041082 | 5/1981 | Fed. Rep. of Germany | 2/424 |
| 2352507 | 1/1978 | France | 2/424 |
| 2024927 | 1/1980 | United Kingdom | 2/10 |
| 1560723 | 2/1980 | United Kingdom | 2/424 |

*Primary Examiner*—Werner H. Schroeder
*Assistant Examiner*—Michael A. Neas
*Attorney, Agent, or Firm*—Rogers, Howell & Haferkamp

[57] ABSTRACT

A motorcycle helmet angle-adjustable wind visor mounting structure used for a motorcycle helmet comprising a pair of attachment mechanisms securable to opposite sides of the helmet, an angle-adjustable wind visor for mounting pivotally to the attachment mechanism, and a cover plate. The attachment mechanism comprises a U-shaped bracket having center and side portions and a respective catch formed on the side portions. The wind visor has a pair of visor rings rotatable on the U-shaped bracket while being prevented disengagement with the same. The cover plate is provided with an enclosure wall substantially at a bottom and rear circumference thereof to stop the wind visor in a first orientation. The wind visor is mountable to or detachable from the U-shaped bracket in a second orientation where the wind visor is rotated further back than in the first orientation.

2 Claims, 4 Drawing Sheets

MOTORCYCLE HELMET ANGLE-ADJUSTABLE WIND VISOR MOUNTING STRUCTURE

BACKGROUND OF THE INVENTION

The present invention relates generally to motorcycle helmets having angle-adjustable wind visors. More particularly, the present invention relates to a mounting structure for motorcycle helmet angle-adjustable wind visors.

It is realized that motorcycle helmets equipped with angle-adjustable wind visors are used so frequently that their components, e.g., the wind visor, cover plate, etc., are liable to have accelerated wear caused directly or indirectly by fastening and loosening bolts and screws or the like.

An improved type of a motorcycle helmet is disclosed in my U.S. application Ser. No. 07/399,245, filed on Aug. 28, 1989, now U.S. Pat. No. 5,005,221, and by this reference incorporated herein as if the same were reproduced herein. Although the device disclosed in that reference overcomes the above drawback or limitation of the prior art, additional improvements have been made thereto.

SUMMARY OF THE INVENTION

Accordingly, it is an object of this invention to provide a motorcycle helmet with an angle-adjustable wind visor that provides a far more simpler and efficient structure.

A further object of this invention is to provide a a mounting structure for motorcycle helmet angle-adjustable wind visors in order to facilitate the adjustment, mount and replacement operation of the motorcycle wind visor.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
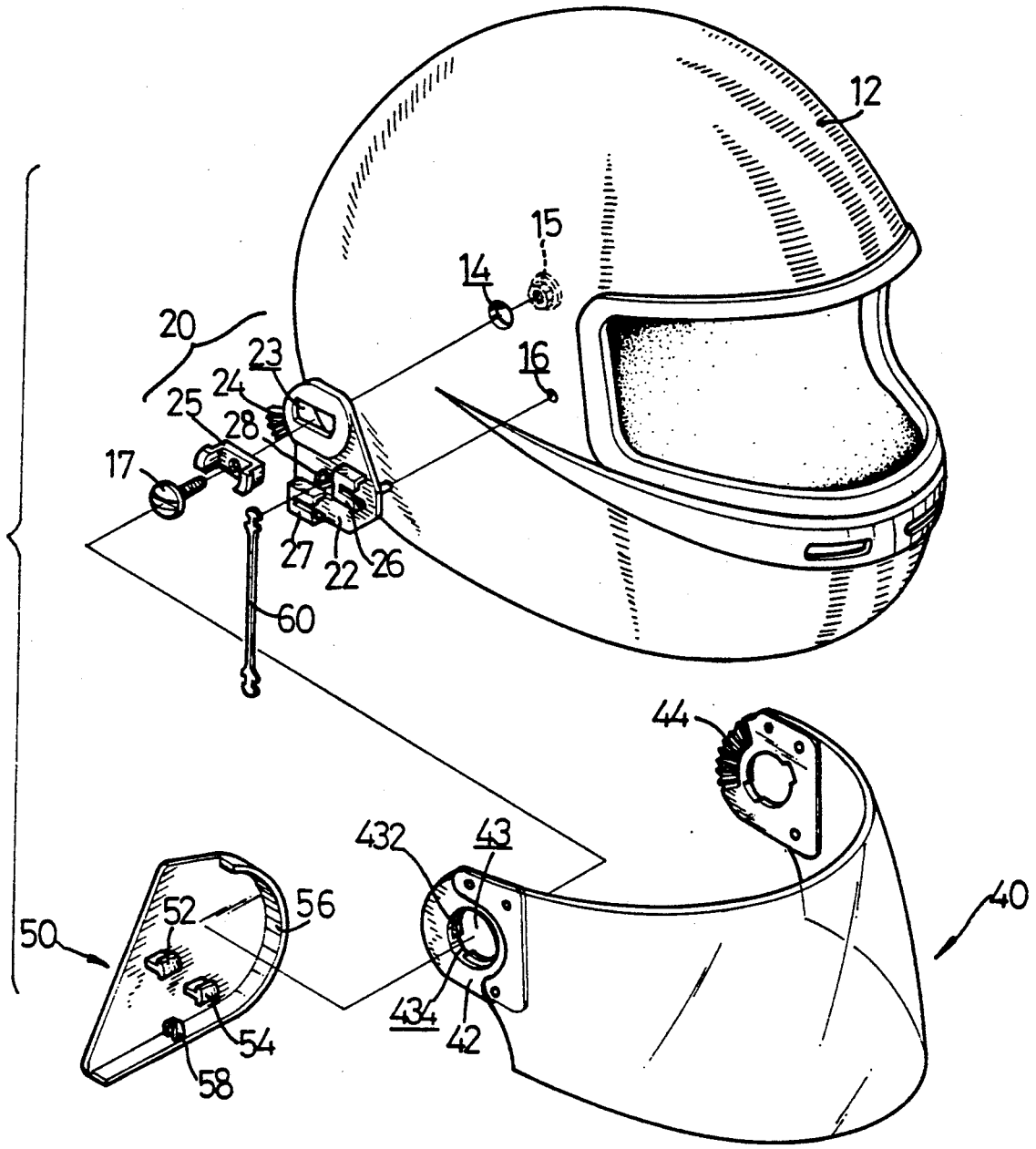
FIG. 1 is a perspective exploded view of a motorcycle helmet in accordance with the invention.
Figure 3:
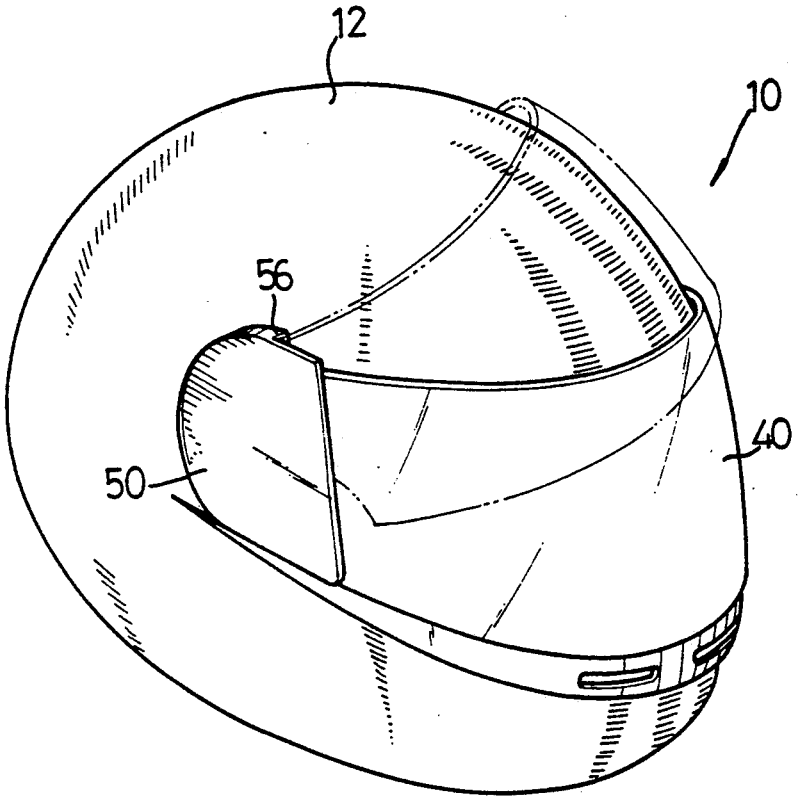
FIG. 3 is a perspective view of the motorcycle helmet of FIG. 1 in assembled arrangement.

Referring to the drawings, and more particularly to FIGS. 1 and 3, there is shown a motorcycle helmet, generally designated by reference number 10, constructed in accordance with the present invention. The motorcycle helmet 10 substantially comprises a helmet body 12, a pair of attachment means 20, a wind visor 40, and a respective cover plate 50 for each attachment means 20. The helmet body 12 has a known construction and at least comprises a hole 14 accommodating a locknut 15 and a hole 16 on each side thereof. It should be appreciated that the arrangement of the attachment means 20 and cover plates 50 is duplicated at each side of helmet body 12. For purposes of simplifying the description only one upright member and one pair of parallel members is shown.

The attachment means 20 substantially comprises an attachment piece 22 from which extends an integral friction piece 24, a U-shaped bracket 25 to be received by a rectangular opening 23 provided on the attachment piece 22, a first receiving slot 26 and a second receiving slot 27 spaced and offset from the first receiving slot 26. The first and second receiving slots 26, 27 each are formed by a box-like element having one open side and one slotted side, as can be clearly seen from FIG. 1. The U-shaped bracket 25 has a center portion 252 and two side portions 254. The center portion 252 is provided a center hole. The side portions 254 each have a respective catch 256 on an outer surface thereof (cf. FIG. 4). A positioning leg is also integrally formed on the attachment piece 22 to engage with the hole 16 on the helmet body 12.

Figure 2:
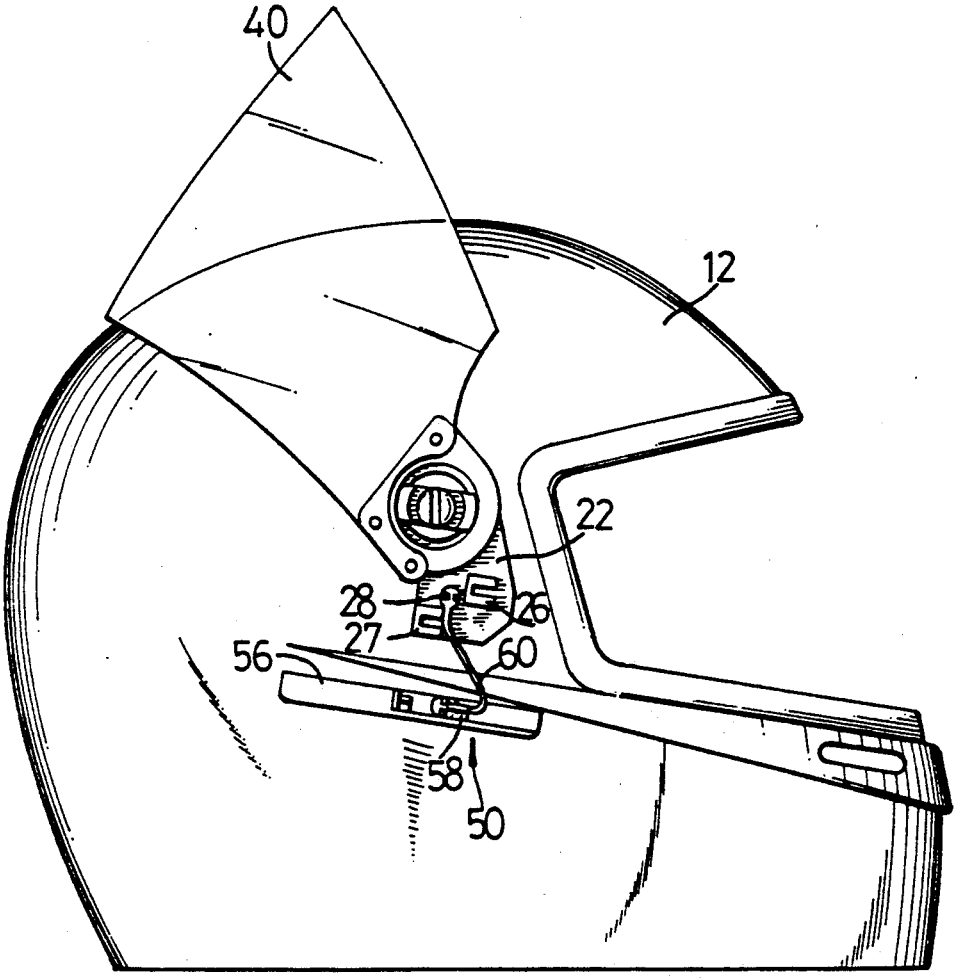
FIG. 2 is a side view showing an orientation where the wind visor is mounted on the attachment means, as well as showing the cover plate being connected to the attachment means by a linking strip.

The wind visor 40 has a pair of visor rings 42 on opposite sides of its main body. The visor ring 42 is provided with friction tracks 44 on part of its inner side so that the wind visor 40 is engageable with the friction piece 24 and bracket 25 to adjust its orientation relative to the motorcycle helmet body 12. The visor ring 42 of the wind visor 40 also comprises a mounting hole 43 which has inner walls 432 on an inner circumference thereof with two securement slots 434 spaced diametrically opposite each other therebetween. It is understood from this construction that the visor ring 42 can be mounted onto the U-shaped bracket 25 only by positioning the visor ring 42 in an orientation, as shown in FIG. 2, such that the two securement slots 434 of the mounting hole 43 align with the side portions 254 of the U-shaped bracket 25 and permit the same to pass. In this manner, the visor ring 42 is rotatably supported on the side portions 254 of the U-shaped bracket 25 such that the wind visor 40 is angle-adjustable or pivotally mounted on the attachment means 20.

Figure 4:
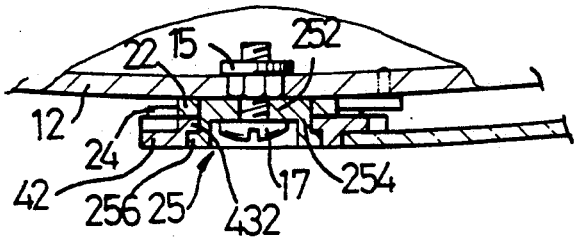
FIG. 4 is a detailed section view showing the attachment piece fixedly attached to the helmet body with the wind visor interposed therebetween.

FIG. 4 shows a detail section view of the interconnection for the attachment means 20, the wind visor 40 and the helmet body 12. The visor ring 43 is rotatable about the U-shaped bracket 25 and is angle-adjustable with the engagement of the friction tracks 44 and the friction piece 24. From the above, it should also be clear that the attachment means 20 can be fixedly secured to the motorcycle helmet body 12 by screw 17 passing through the center hole of the U-shaped bracket 25 and the hole 14 to engage with the locknut 15, with the wind visor 40 pivotally interposed therebetween.

The cover plate 50 comprises respective protuberances 52 and 54 of substantially T-shaped cross-section and an enclosure wall 56 substantially at a bottom and rear circumference thereof. The protuberances 52 and 54 frictionally insertable into the first and second receiving slots 26 and 27 so that the cover plate 50 is engageable with each attachment means 20 for covering the visor ring 42 of the wind visor 40. The enclosure wall 56 stops a rearward pivotal movement of the wind visor 40 in an orientation shown by the phantom lines in FIG. 3, where the wind visor 40 is in a lower and more forward position than what was described in FIG. 2 for mounting the wind visor 40 to the attachment means 20.

As can be seen from FIGS. 1 and 2, there is a linking strip 60 having one end releasably fixed to an anchoring clip 28 provided on the attachment means 20 and the other end releasably fixed to another anchoring clip 58 provided on the cover plate 50. The linking strip 60 connects the cover plate 50 to the attachment means 20 even when the cover plate 50 is detached from the attachment means 20. This secures the cover plate 50 from being inadvertently lost during operation.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A wind visor mounting structure for a helmet of the type having a helmet body, a pair of attachment pieces, each attachment piece of the pair mounted to an opposite side of the helmet body, a wind visor mounted in a pivotable relationship to the attachment pieces, and a pair of cover plates, each cover plate of the pair being secured to one of the attachment pieces for covering one of a pair of mounting portions of the wind visor, the improvement comprising:

each attachment piece comprising an integral friction piece extending from a side thereof and a first and a second receiving slot offset from each other;

said wind visor having a pair of visor rings and at most two opening for mounting of the cover plate and adjustability of the wind visor, each visor ring of the pair being at one of the mounting portions and having one of the two openings therethrough and a friction trach on a side facing said friction piece facing said friction piece for engaging with said friction piece, thereby permitting a change of orientation of said wind visor relative to said pair of attachment pieces; and each said cover plate for comprising a first and a second protuberance, each protuberance having a substantially T-shaped cross-section and corresponding to one of said receiving slots, said protuberances being frictionally insertable into said first and second receiving slots, thereby retaining each said cover plate attached to said attachment piece.

2. A wind visor mounting structure as set forth in claim 1, wherein:

each protuberance has a shank and cross-head thereby defining the T-shaped cross-section, and the protuberances are frictionally insertable into the receiving slots with the shanks of the protuberances extending through the slots.

* * * * *